US008925919B2

(12) United States Patent
Park et al.

(10) Patent No.: US 8,925,919 B2
(45) Date of Patent: Jan. 6, 2015

(54) APPARATUS FOR ALIGNING BILL AND METHOD FOR ALIGNING BILL USING THE SAME

(71) Applicant: Nautilus Hyosung Inc., Seoul (KR)

(72) Inventors: Chang Ho Park, Gunpo-si (KR); Young Chul Lee, Anyang-si (KR); Jin Young Hwang, Seoul (KR); Jun Young Kim, Gyeonggi-do (KR); Jong Seong Park, Anyang-si (KR)

(73) Assignee: Nautilus Hyosung Inc., Seoul (KR)

( * ) Notice: Subject to any disclaimer, the term of this patent is extended or adjusted under 35 U.S.C. 154(b) by 0 days.

(21) Appl. No.: 14/099,688

(22) Filed: Dec. 6, 2013

(65) Prior Publication Data

US 2014/0312561 A1 Oct. 23, 2014

(30) Foreign Application Priority Data

Apr. 23, 2013 (KR) ..... 10-2013-0044544

(51) Int. Cl.

| | |
|---|---|
| ***B65H 9/16*** | (2006.01) |
| ***B65H 9/00*** | (2006.01) |
| ***B65H 5/06*** | (2006.01) |
| ***B65H 7/06*** | (2006.01) |
| ***B65H 7/10*** | (2006.01) |
| ***B65H 9/10*** | (2006.01) |

(52) U.S. Cl.

CPC ..... *B65H 9/002* (2013.01); *B65H 5/06* (2013.01); *B65H 7/06* (2013.01); *B65H 7/10* (2013.01); *B65H 9/106* (2013.01); *B65H 2402/10* (2013.01); *B65H 2402/32* (2013.01); *B65H 2404/133* (2013.01); *B65H 2404/1523* (2013.01); *B65H 2404/1544* (2013.01); *B65H 2701/1912* (2013.01)

USPC ..... 271/252; 271/227; 271/230; 271/234; 271/239; 271/249; 271/253; 271/254

(58) Field of Classification Search

CPC .... B65H 1/04; B65H 9/04; B65H 2701/1313; B41F 1/28; B41G 3/00

USPC ..... 271/227, 230, 234, 239, 252–254, 249

See application file for complete search history.

(56) References Cited

U.S. PATENT DOCUMENTS 5,219,159 A * 6/1993 Malachowski et al. ..... 271/228
7,631,867 B2 12/2009 Dejong et al.

(Continued)

FOREIGN PATENT DOCUMENTS

| | | |
|---|---|---|
| JP | 2001-240291 | 9/2001 |
| KR | 10-2007-0079669 | 8/2007 |
| KR | 10-1059143 | 8/2011 |

*Primary Examiner* — Prasad Gokhale

(74) *Attorney, Agent, or Firm* — Fenwick & West LLP

(57) ABSTRACT

Disclosed herein are an apparatus and method for aligning a bill supplied to a transfer path with a center line of the transfer path. The apparatus includes a fixed support unit which moves a bill in a transfer direction of the transfer path, a movable support unit which is disposed in succession to the fixed support unit and is provided so as to be movable in a lateral direction of the transfer path, a bill position sensor which senses the position of the bill that moves on the fixed support unit and the movable support unit, and a controller which is controls a lateral displacement of the movable support unit in response to information about the position of the bill, thus aligning the bill with the center line.

10 Claims, 13 Drawing Sheets

(56) References Cited

U.S. PATENT DOCUMENTS

| | | | | |
|---|---|---|---|---|
| 8,056,897 | B2 | 11/2011 | deJong et al. | |
| 8,371,578 | B2 * | 2/2013 | Ishikawa et al. | 271/227 |
| 8,523,235 | B2 | 9/2013 | Kwak et al. | |
| 2004/0046316 | A1 * | 3/2004 | Tsuzawa | 271/264 |
| 2007/0181668 | A1 | 8/2007 | Kwak et al. | |
| 2009/0134569 | A1 * | 5/2009 | Matsui | 271/227 |
| 2009/0166960 | A1 * | 7/2009 | Ishikawa et al. | 271/227 |
| 2011/0215522 | A1 | 9/2011 | deJong et al. | |
| 2013/0249166 | A1 * | 9/2013 | Abe et al. | 271/314 |
| 2013/0300055 | A1 * | 11/2013 | Ishikawa et al. | 271/227 |

* cited by examiner

APPARATUS FOR ALIGNING BILL AND METHOD FOR ALIGNING BILL USING THE SAME

FIELD OF THE INVENTION

The present invention relates generally to apparatuses for aligning bills and methods for aligning bills using the apparatuses and, more particularly, to a bill alignment apparatus which can successively transfer and align bills supplied onto a transfer path.

BACKGROUND OF THE INVENTION

Generally, different kinds of banking ATMs (automated teller machines) have come into wide use in banks. Among the banking ATMs, bill receiving and processing machines receive bills, for example, an individual bill or check, and automatically process the bills or checks.

For instance, when a customer or a teller puts bills into a receiving port of a bill receiving and processing machine, each of the supplied bills is transferred along a transfer path formed in the bill receiving and processing machine and aligned with one side edge of the transfer path. Thereafter, after the authenticity of each bill is verified, when the bill is normal, the bill is finally received and processed. If the bill is abnormal, the reception of the bill is rejected and it is discharged.

Here, in the case where the bills are aligned with one side edge of the transfer path, the distance that each bill must be moved on the transfer path may be excessively long depending on the position at which the bill is placed on the transfer path.

To avoid the above problem, a technique of aligning a bill with a center line of the transfer path to reduce the time it takes to move the bill and minimize displacement of the bill is required.

SUMMARY OF THE INVENTION

It is, therefore, an object of the present invention to provide an apparatus for aligning a bill which can improve the ability to align a bill on the transfer path, and a method for aligning the bill using the apparatus.

In accordance with a preferred embodiment of the present invention, there is provided an apparatus for aligning a bill supplied onto a transfer path with a center line of a transfer path, the apparatus including: a fixed support unit comprising a first transfer roller applying frictional force to the bill so that the bill is moved in a transfer direction of the transfer path; a movable support unit disposed in succession to the fixed support unit, the movable support unit being provided so as to be movable in a lateral direction of the transfer path to move the bill in the lateral direction of the transfer path; a bill position sensor sensing a position of the bill; and a controller controlling a lateral displacement of the movable support unit in response to information about the position of the bill, thus aligning the bill with the center line.

The fixed support unit may include a first fixed support unit disposed in succession at an entrance side of the movable support unit, and a second fixed support unit disposed in succession at an exit side of the movable support unit.

The movable support unit may include a second transfer roller providing frictional force to the bill so that the bill that has been moved from the fixed support unit onto the movable support unit is moved in the transfer direction of the transfer path by the second transfer roller, a movable plate in which the second transfer roller is rotatably installed, and an actuator moving the movable plate in the lateral direction of the transfer path.

The bill position sensor may include an entrance position sensor providing information about an alignment entrance of the fixed support unit, the alignment of the bill beginning at the alignment entrance of the fixed support unit, and an exit position sensor providing information about an alignment exit of the fixed support unit, the alignment of the bill being completed at the alignment exit of the fixed support unit.

The entrance position sensor may include a plurality of entrance position sensors arranged at positions spaced apart from each other in the lateral direction of the fixed support unit, the entrance position sensors providing lateral position information of the bill to the controller.

The fixed support unit may include a plurality of fixed support units, and the movable support unit comprises a plurality of movable support units, wherein the fixed support units and the movable support units successively alternate with each other.

In accordance with another preferred embodiment of the present invention, there is provided a method for aligning a bill, including: supplying a bill onto a transfer path comprising a movable support unit provided so as to movable in a lateral direction; moving the movable support unit in the lateral direction of the transfer path to align the bill with a center line of the transfer path when the bill enters the movable support unit; and moving the bill out of the movable support unit after the bill is aligned with the center line of the transfer path.

The operation of supplying the bill onto the transfer path may include supplying bills onto the transfer path in such a way that the bills are spaced apart from each other by a distance corresponding to at least a length of the movable support unit.

The operation of moving the movable support unit in the lateral direction of the transfer path may include calculating a lateral displacement distance of the movable support unit to align the bill with the center line of the transfer path based on lateral position information of the bill, and moving the movable support unit in response to the calculated lateral displacement distance.

The operation of moving the movable support unit in the lateral direction of the transfer path may include moving the bill in a transfer direction of the transfer path using a second transfer roller provided in the movable support unit.

The operation of moving the bill out of the movable support unit may include returning the movable support unit to an original position thereof after the bill comes out of the movable support unit.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Hereinafter, the construction, coupling relationship and operational principle of preferred embodiments of the present invention will be described in detail with reference to the accompanying drawings. If in the specification, detailed descriptions of well-known functions or configurations would unnecessarily obfuscate the gist of the present invention, the detailed descriptions will be omitted.

The terms and words used for elements in the description of the present invention have been determined in consideration of the functions of the elements in the present invention. The terms and words may be changed depending on the intention or custom of users or operators, so that they must be defined based on the whole content of the specification of the present invention.

The preferred embodiment of the present invention will be explained in detail with reference to the attached drawings.

First Embodiment

Although a bill alignment apparatus according to the first embodiment will be described as aligning a bill using an exit position sensor to obtain precise information from the bill supplied to a transfer path or efficiently control the bill, the present invention is not limited to this structure. For example, bills may be aligned with one side edge of the transfer path depending on design conditions of the apparatus or design conditions of peripheral devices of the apparatus.

Figure 1:
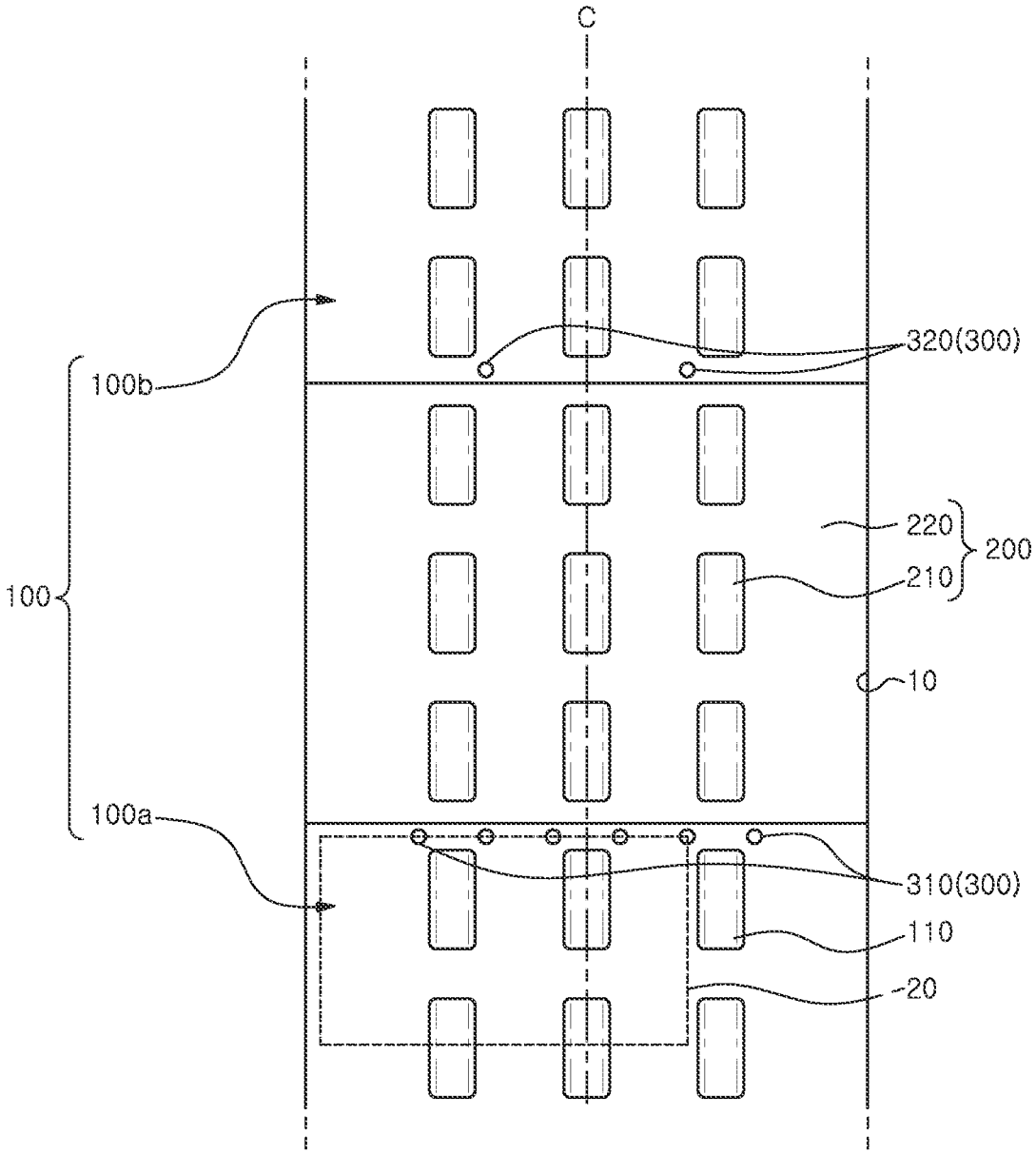
FIG. 1 is a plan view schematically showing a bill alignment apparatus, in accordance with a first embodiment of the present invention.
Figure 2:
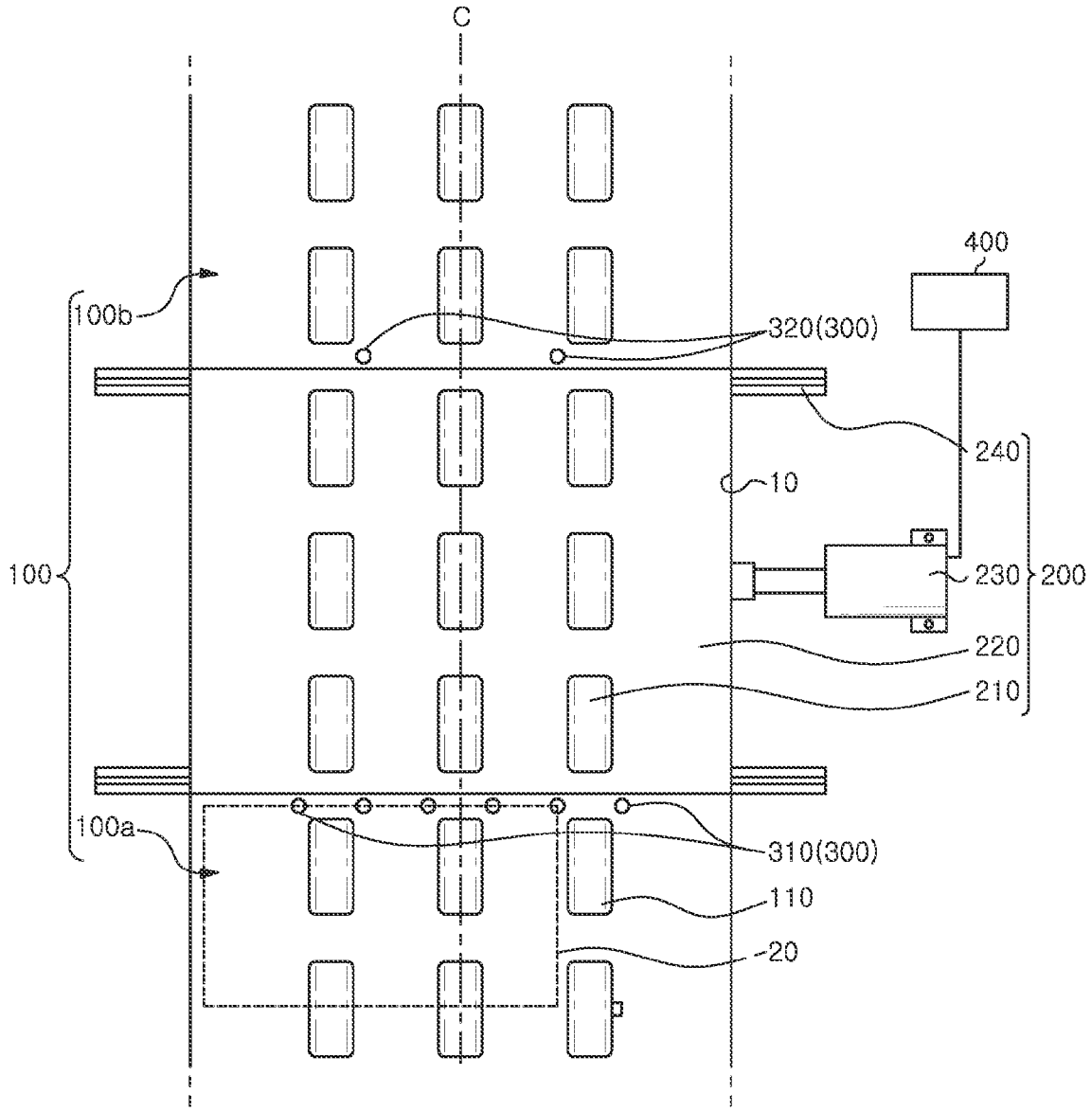
FIG. 2 is a plan view illustrating an actuator installed in the bill alignment apparatus in accordance with the first embodiment of the present invention.

FIG. 1 is a plan view schematically showing the bill alignment apparatus in accordance with the first embodiment of the present invention. FIG. 2 is a plan view illustrating an actuator installed in the bill alignment apparatus in accordance with the first embodiment of the present invention.

As shown in FIGS. 1 and 2, the bill alignment apparatus in accordance with the first embodiment includes a fixed support unit 100, a movable support unit 200, a bill position sensor 300 and a controller 400. The bill alignment apparatus aligns a bill 20 with a center line C of a transfer path 10.

In detail, the fixed support unit 100 includes the transfer path 10 which transfers the bill 20 in a transfer direction of the transfer path 10. The fixed support unit 100 applies frictional force to the bill 20 so that the bill 20 can reliably move along the transfer path 10.

A plurality of first transfer rollers 110 are rotatably installed in the fixed support unit 100 to transfer the bill 20. The first transfer rollers 110 are arranged in lines and rows in the fixed support unit 100 and oriented parallel to the transfer direction of the transfer path 10. The first transfer rollers 110 are spaced apart from each other by an appropriate distance at which the first transfer rollers 110 can support the bill 20 in a balanced way and successively transfer the bill 20.

The fixed support unit 100 includes a first fixed support unit 100*a* and a second fixed support unit 100*b* which are provided with the movable support unit 200 disposed therebetween. The first fixed support unit 100*a* is successively disposed at an entrance side of the movable support unit 200. The second fixed support unit 100*b* is successively disposed at an exit side of the movable support unit 200.

The movable support unit 200 is successively disposed between the first fixed support unit 100*a* and the second fixed support unit 100*b*. The movable support unit 200 can move in the lateral direction of the transfer path 10 while supporting the bill 20. For this, the movable support unit 200 includes second transfer rollers 210, a movable plate 220 and an actuator 230.

The second transfer rollers 210 of the movable support unit 200 are provided so as to be rotatable and arranged in the movable plate 220 in lines and rows. The second transfer rollers 210 apply frictional force to the bill 20 to transfer the bill 20 in the transfer direction of the transfer path 10.

Here, the second transfer rollers 210 are spaced apart from each other by an appropriate distance at which the second transfer rollers 210 can support the bill 20 in a balanced way and successively transfer the bill 20. To prevent the bill 20 from being disposed between the movable support unit 200 and the fixed support unit 100 when the movable support unit 200 moves in the lateral direction of the transfer path 10, bills 20 are supplied onto the transfer path 10 in such a way that the bills 20 are spaced apart from each other by a distance corresponding to at least the length of the movable support unit 200.

The movable plate 220 of the movable support unit 200 can move in the lateral direction of the transfer path 10 along a guide rail 240 which extends a predetermined length in the lateral direction of the transfer path 10. For this, in this embodiment, the movable plate 220 receives a drive force from a separate moving means such as the actuator 230. The actuator 230 is a drive source for moving the movable plate 220 in the lateral direction of the transfer path 10. For example, the actuator 230 may be a hydraulic cylinder which can linearly move the movable plate 220.

In this embodiment, although the actuator 230 such as a hydraulic cylinder has been illustrated as being used as the means for moving the movable plate 220 in the lateral direction of the transfer path 10, the present invention is not limited to this. Various types of means for moving the movable plate 220 in the lateral direction of the transfer path 10 can be used, so long as it can align the bill 20 with the center line C. For example, as the means for moving the movable plate 220, a rotating belt or rotating chain which is connected to a drive motor may be used or, alternatively, a drive wheel which is coupled to the movable plate 220 may be used.

The bill position sensor 300 senses the position of the bill 20 that is being transferred on the fixed support unit 100 and the movable support unit 200 and provides information about the sensed position of the bill 20 to the controller 400.

The bill position sensor 300 includes an entrance position sensor 310 and an exit position sensor 320. The entrance position sensor 310 transmits information about an alignment entrance of the fixed support unit 100, at which alignment of the bill 200 begins, to the controller 400. The exit position sensor 320 transmits information about an alignment exit of the fixed support unit 100, at which the alignment of the bill 200 is completed, to the controller 400.

Particularly, the bill position sensor 300 comprises a plurality of bill position sensors which are arranged on the fixed support unit 100 or the movable support unit 200 at positions spaced apart from each other in the lateral direction of the transfer path 10. The bill position sensors 300 can provide information about the lateral position of the bill 20 to the controller 400.

For instance, in the case where a plurality of entrance position sensors 310 are arranged in the lateral direction in the alignment entrance of the transfer path 10, when some of the entrance position sensors 310 sense the bill 20, the entrance position sensors 310 that have sensed the bill 20 transmit alignment entrance information and lateral position information of the bill 20 to the controller 400.

The controller 400 receives the position information of the bill 20 from the bill position sensors 300 and adjusts the lateral position of the movable support unit 200 in response to the received information, thus aligning the bill 20 with the center line C of the transfer path 10.

When the alignment entrance information and the lateral position information of the bill 20 is transmitted from some of the entrance position sensors 310 to the controller 400, the controller 400 can determine a current position and a lateral position of the bill 20 in response to the alignment entrance information and the lateral position information. Given the current position and the lateral position of the bill 20, the controller 400 calculates the time to move the movable support unit 200 and the distance that the movable support unit 200 is moved in the lateral direction.

When the bill 20 completely enters the movable support unit 200, the controller 400 moves the movable support unit 200 in the lateral direction of the transfer path 10 in response to the calculated lateral displacement distance of the movable support unit 200, thereby aligning the bill 200 with the center line C of the transfer path 10.

Thereafter, when the bill 20 comes out of the movable support unit 200, the exit position sensors 320 transmit alignment exit information of the bill 20 to the controller 400. Then, the controller 400 moves the movable support unit 200 to its original position.

The operation of the bill alignment apparatus in accordance with the first embodiment of the present invention having the above-mentioned construction will be described below.

Figure 3:
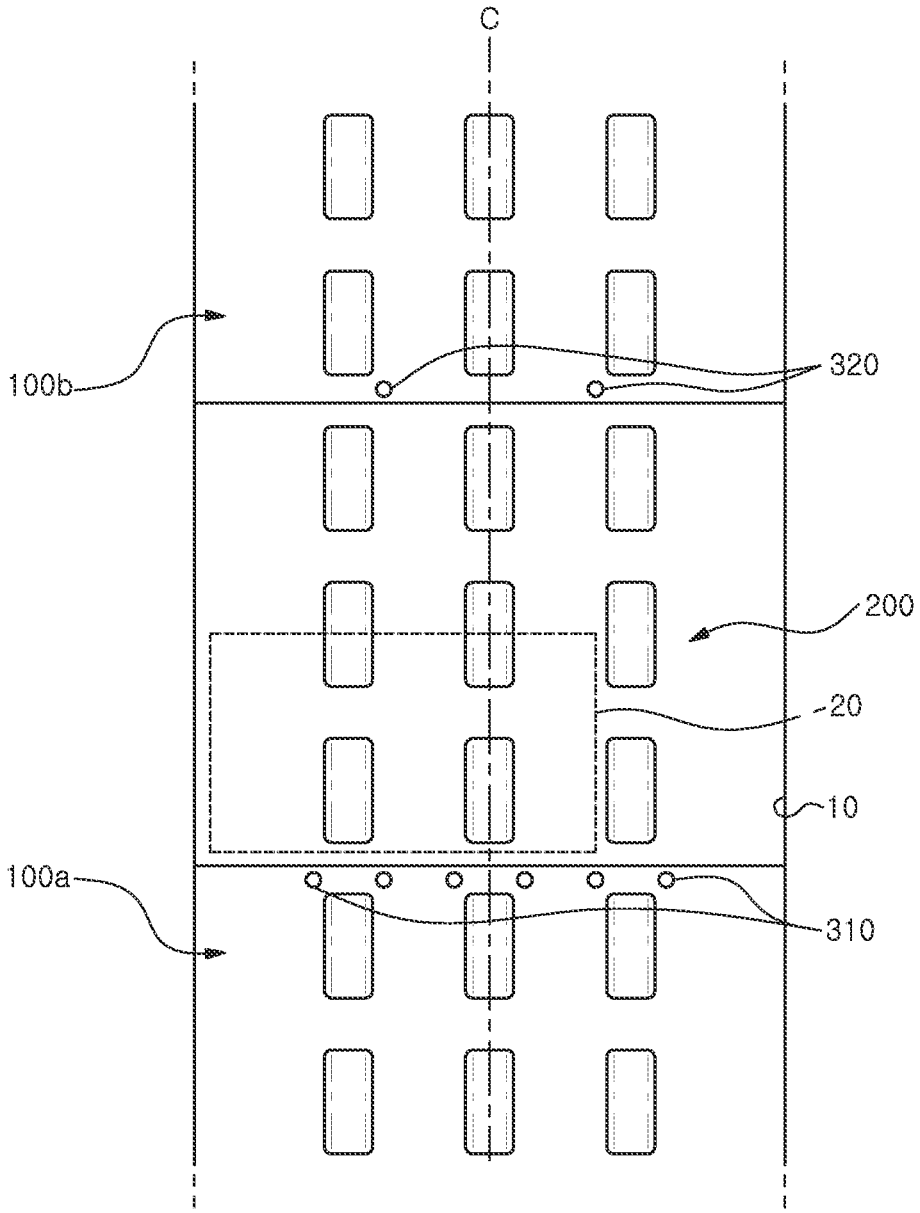
FIG. 3 illustrates conditions in which a bill has entered a movable support unit of the bill alignment apparatus in accordance with the first embodiment of the present invention.
Figure 4:
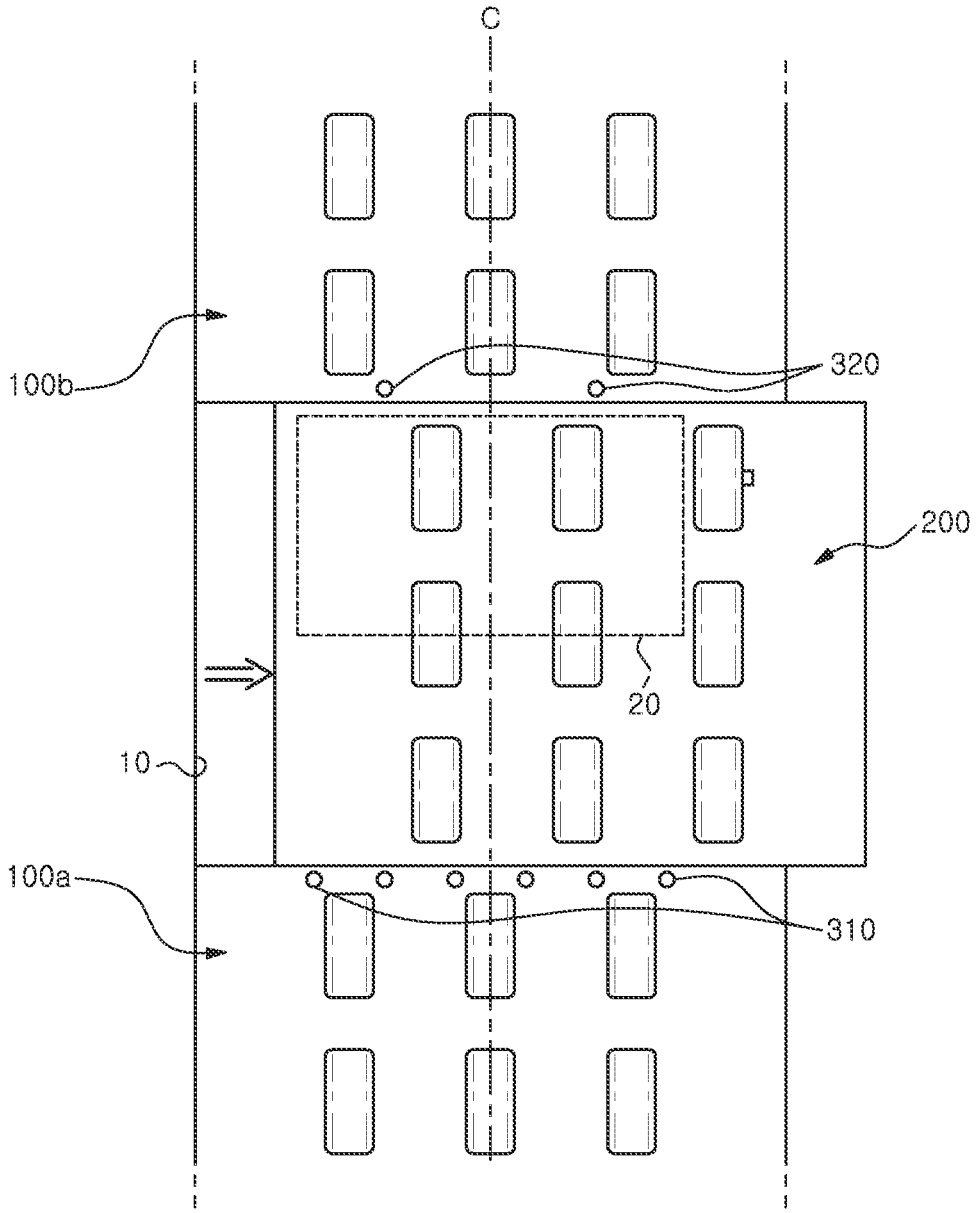
FIG. 4 is a view showing conditions in which the movable support unit on which the bill is placed is moved in a lateral direction for bill alignment, in the bill alignment apparatus in accordance with the first embodiment of the present invention.
Figure 5:
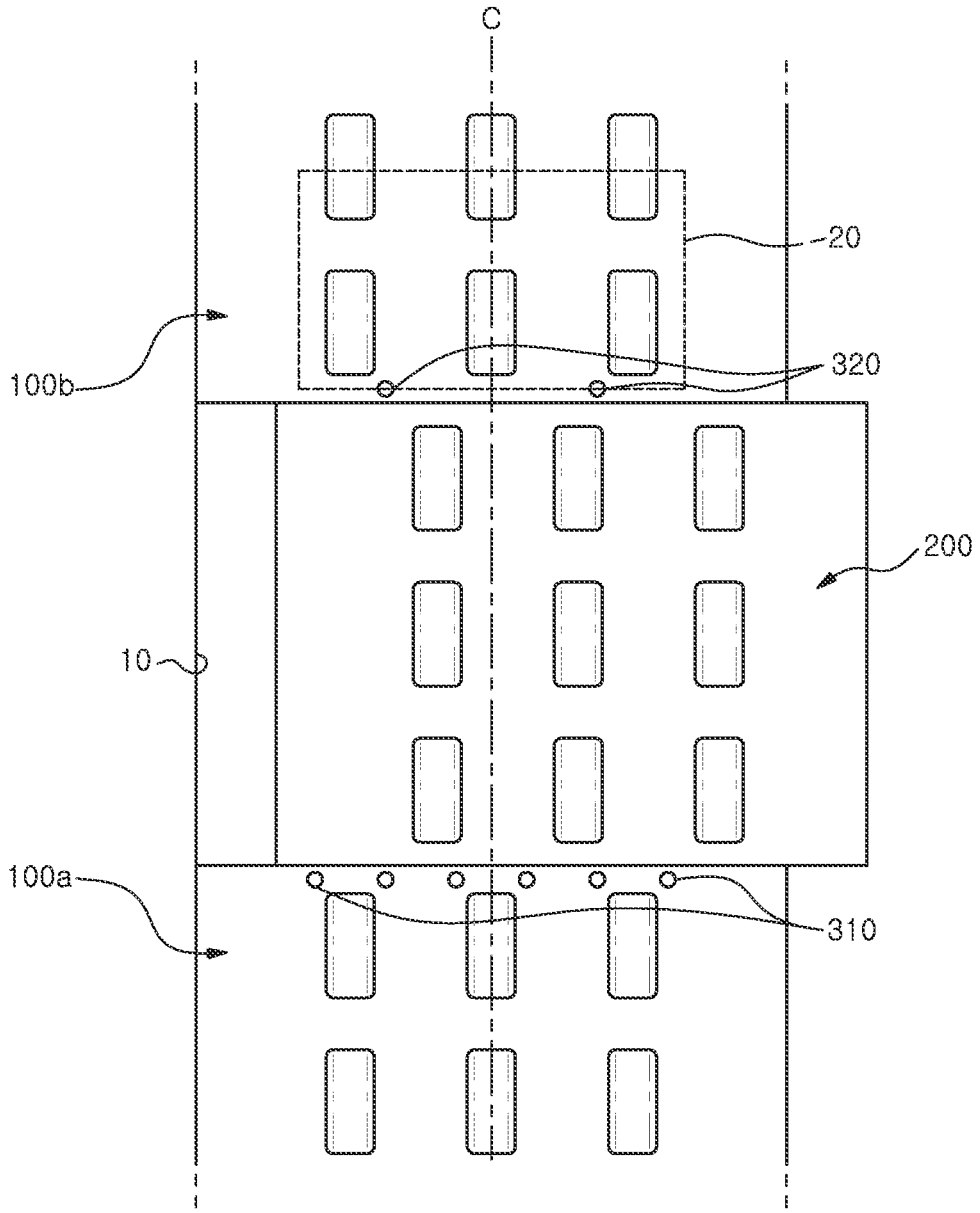
FIG. 5 illustrates conditions in which the bill has come out of the movable support unit of the bill alignment apparatus in accordance with the first embodiment of the present invention.
Figure 6:
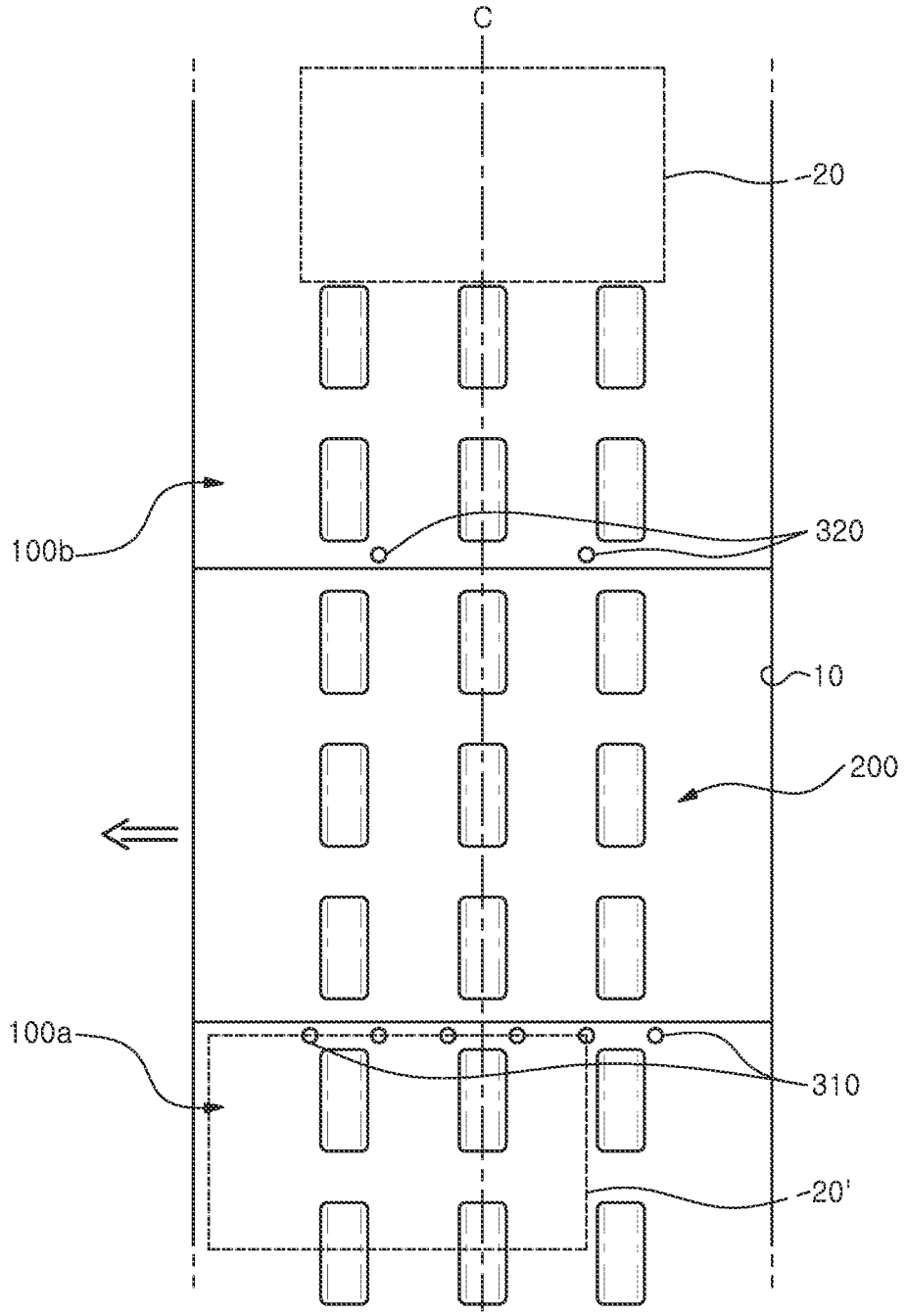
FIG. 6 illustrates conditions in which the movable support unit has returned to its original position in the bill alignment apparatus in accordance with the first embodiment of the present invention.

FIG. 3 illustrates conditions in which the bill has entered the movable support unit of the bill alignment apparatus in accordance with the first embodiment of the present invention. FIG. 4 is a view showing conditions in which the movable support unit on which the bill is placed is moved in the lateral direction for bill alignment, in the bill alignment apparatus in accordance with the first embodiment of the present invention. FIG. 5 illustrates conditions in which the bill has come out of the movable support unit of the bill alignment apparatus in accordance with the first embodiment of the present invention. FIG. 6 illustrates conditions in which the movable support unit has returned to its original position in the bill alignment apparatus in accordance with the first embodiment of the present invention.

As shown in FIG. 3, the bill 20 that has passed through the first fixed support unit 100*a* enters the movable support unit 200. At this time, when the bill 20 passes over some of the entrance position sensors 310 provided on the first fixed support unit 100*a*, the entrance position sensors 310 transmit alignment entrance information and lateral position information of the bill 20 to the controller 400. The controller 400 calculates the time to move the movable support unit 200 and a lateral displacement distance of the movable support unit 200 based on the alignment entrance information and the lateral position information.

As shown in FIG. 4, the bill 20 placed on the movable support unit 200 is moved by the second transfer rollers 210 towards the alignment exit side in the transfer direction of the transfer path 10 and, simultaneously, is aligned with the center line C of the transfer path 10 by lateral movement of the movable support unit 200.

For instance, the controller 400 applies an operational signal to the second transfer rollers 210 of the movable support unit 200 so that the bill 20 can be transferred towards the alignment exit side in the transfer direction of the transfer path 10. Simultaneously, in response to the calculated lateral displacement distance, the movable support unit 200 is moved in the lateral direction of the transfer path 10.

As such, the bill 20 that has entered the movable support unit 200 is moved towards the center line C by the lateral movement of the movable support unit 200 and is transferred in the transfer direction of the transfer path 10 by the second transfer rollers 210 of the movable support unit 200. Thereby, the time it takes to transfer the bill 20 on the movable support unit 200 or pile bills on top of one another can be reduced.

As shown in FIG. 5, the bill 20 that has come out of the movable support unit 200 enters the second fixed support unit 100*b*. Here, the bill 20 can be continuously transferred in the transfer direction of the transfer path 10 both by the second transfer rollers 210 of the movable support unit 200 and by the first transfer rollers 110 of the second fixed support unit 100*b*. In addition, the bill 20 can be maintained aligned with the center line C of the transfer path 10.

As shown in FIG. 6, the bill 20 that has been aligned with the center line C of the transfer path 10 can be continuously moved in the transfer direction of the transfer path 10 by the first transfer rollers 110 of the second fixed support unit 100*b*. At this time, another bill 20' that has supplied onto the transfer path 10 can enter the first fixed support unit 100*a*, and the movable support unit 200 returns to its original position to receive the bill 20' thereonto.

Second Embodiment

The general construction of a bill alignment apparatus in accordance with the second embodiment of the present invention, other than the fact that movable support units and fixed support units alternate with each other, is the same as that of the first embodiment. Therefore, the same or similar reference numerals will be used to designate elements equal to or corresponding to those of FIGS. 1 through 2, and further explanation of these elements will be omitted.

Figure 7:
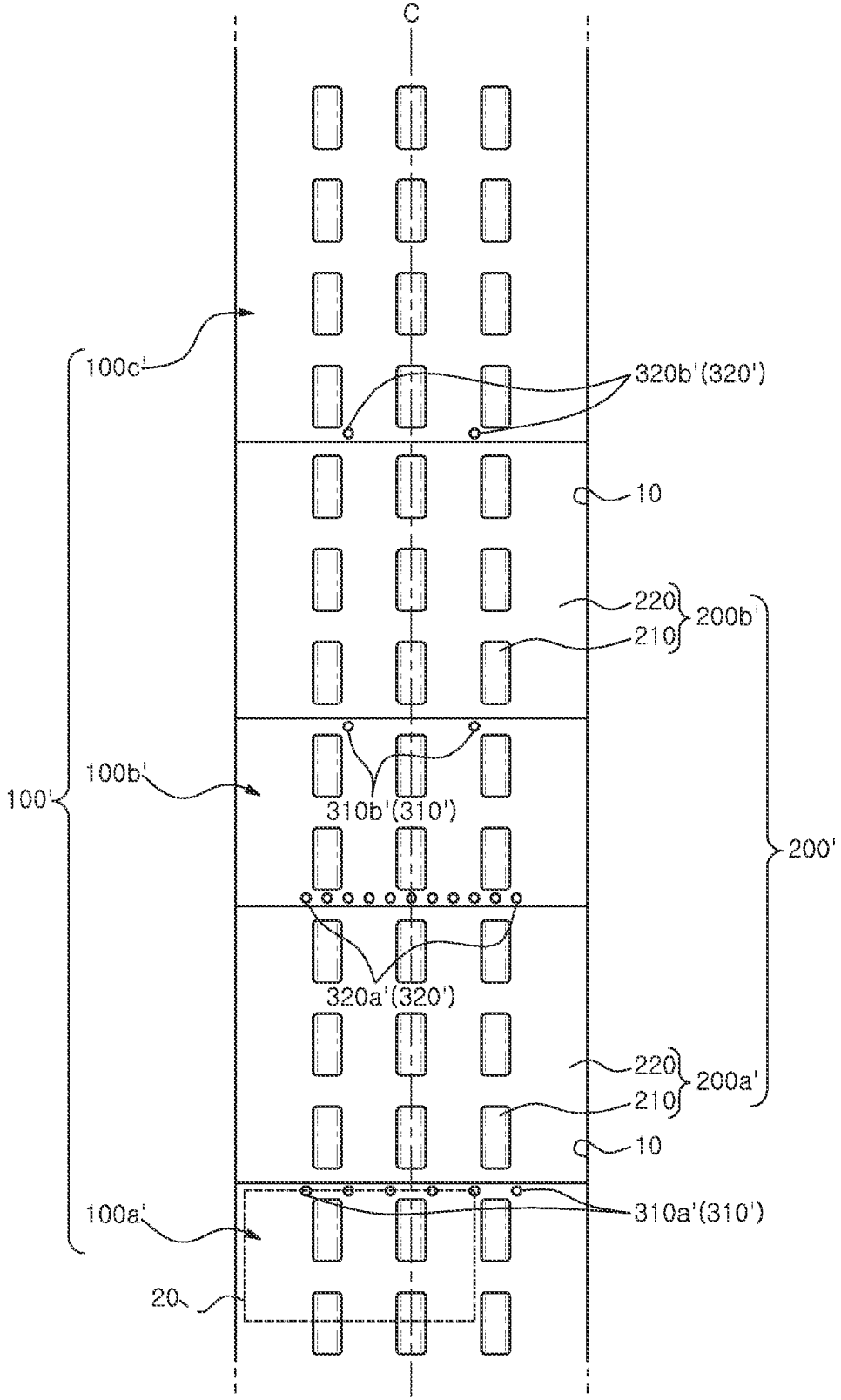
FIG. 7 is a plan view schematically showing a bill alignment apparatus, in accordance with a second embodiment of the present invention.

FIG. 7 is a plan view schematically showing the bill alignment apparatus, in accordance with the second embodiment of the present invention.

As shown in FIG. 7, the bill alignment apparatus in accordance with the second embodiment conducts several bill alignment processes for aligning the bill 20 that is moving along the transfer path 10, thus further enhancing precision and reliability in the alignment of bill 20. For this, fixed support units 100' and movable support units 200' are alternately arranged in the transfer direction of the transfer path 10. In detail, the fixed support unit 100' includes a first fixed support unit 100*a*', a second fixed support unit 100*b*' and a third fixed support unit 100*c*'. The first fixed support unit 100*a*' is successively provided at an entrance side of a first movable support unit 200*a*'. The second fixed support unit 100*b*' is successively provided between an exit side of the first movable support unit 200*a*' and an entrance side of a second movable support unit 200*b*'. The third fixed support unit 100*c*' is successively provided at an exit side of the second movable support unit 200*b*'.

The movable support unit 200' includes the first movable support unit 200*a*' which is successively provided between the first fixed support unit 100*a*' and the second fixed support unit 100*b*', and the second movable support unit 200*b*' which is successively provided between the second fixed support unit 100*b*' and the third fixed support unit 100*c*'. The first movable support unit 200*a*' and the second movable support unit 200*b*' are movable in the lateral direction of the transfer path 10. Each of the first and second movable support units 200*a*' and 200*b*' includes a plurality of second transfer rollers 210 and a movable plate 220.

To sense the position of the bill 20 that is moving on the fixed support unit 100' and the movable support unit 200', a bill position sensor includes an entrance position sensor 310' which has a first entrance position sensor 310*a*' and a second entrance position sensor 310*b*', and an exit position sensor 320' which has a first exit position sensor 320*a*' and a second exit position sensor 320*b*'.

Particularly, the first entrance position sensor 310*a*' comprises a plurality of first entrance position sensors 310*a*' which are provided on the first fixed support unit 100*a*' at positions spaced apart from each other with respect to the lateral direction. Also, the first exit position sensor 320*a*' comprises a plurality of first exit position sensors 320*a*' which are provided on the second fixed support unit 100*b*' at positions spaced apart from each other with respect to the lateral direction. Here, the number of first exit position sensors 320*a*' is greater than the number of the first entrance position sensor 310*a*' so that the first exit position sensors 320*a*' are arranged more closely to each other than are the first entrance position sensors 310*a*'. Thus, the first exit position sensors 320*a*' can more precisely sense the lateral position of the bill 20 on the transfer path 10.

The controller 400 primarily determines the lateral position of the bill 20 using the first entrance position sensors 310*a*' and moves the first movable support unit 100*a*' in the lateral direction of the transfer path 10 in response to information transmitted from the first entrance position sensors 310*a*'. Further, the controller 400 more precisely secondarily determines the lateral position of the bill 20 using the first exit position sensors 320*a*' and moves the second movable support unit 100*b*' in the lateral direction of the transfer path 10 in response to information transmitted from the first exit position sensors 320*a*'.

The operation of the bill alignment apparatus in accordance with the second embodiment of the present invention having the above-mentioned construction will be described below.

Figure 8:
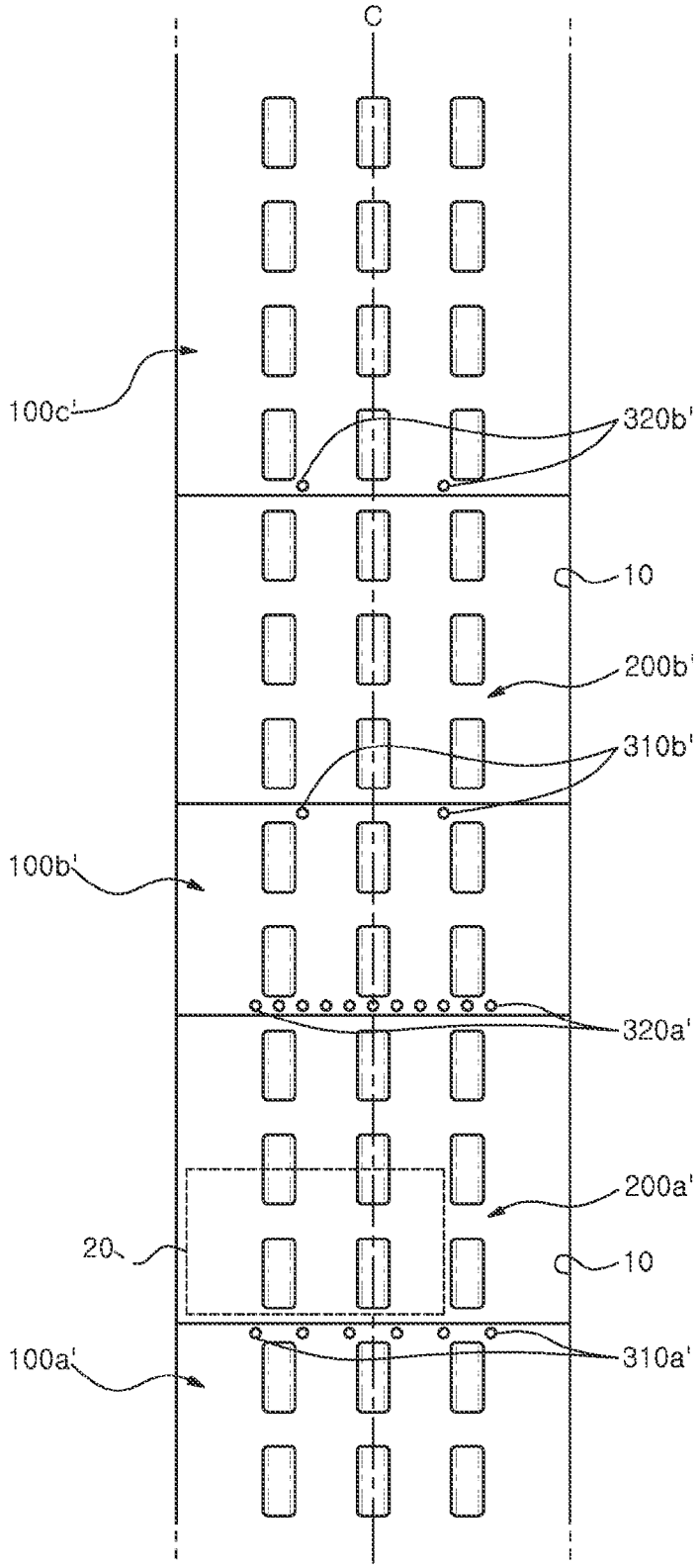
FIG. 8 illustrates conditions in which a bill has entered a first movable support unit of the bill alignment apparatus in accordance with the second embodiment of the present invention.
Figure 9:
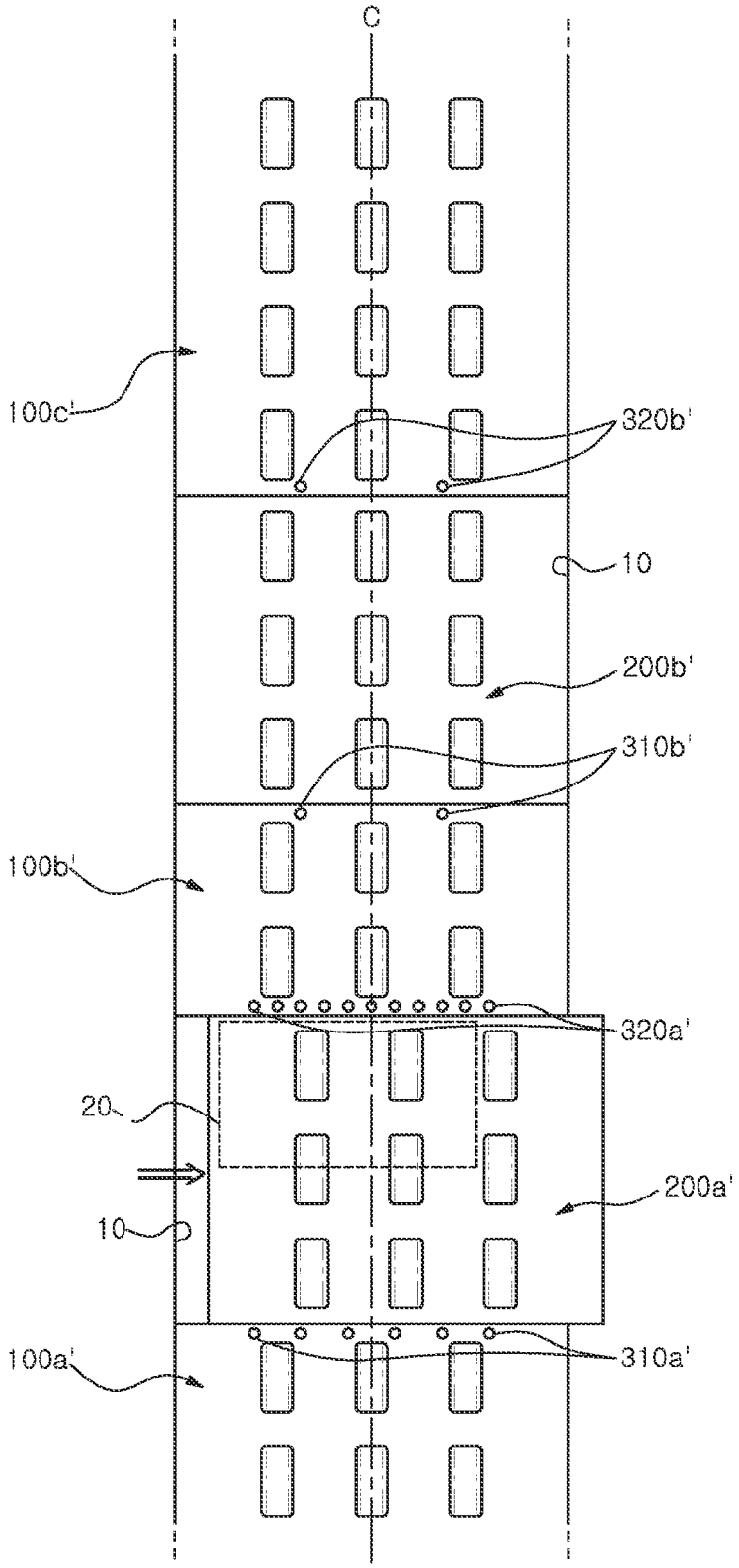
FIG. 9 illustrates conditions in which the first movable support unit on which the bill is placed is moved in a lateral direction for bill alignment, in the bill alignment apparatus in accordance with the second embodiment of the present invention.
Figure 10:
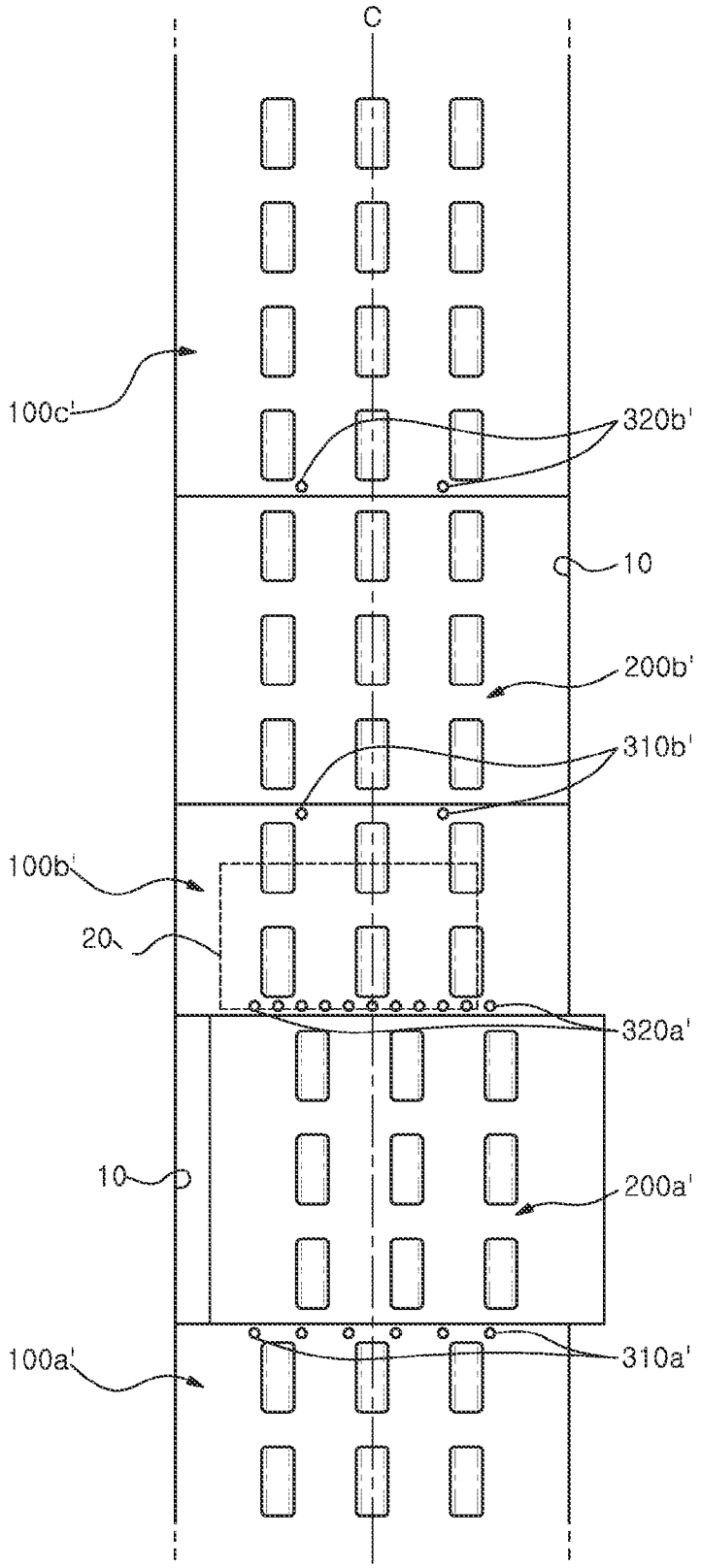
FIG. 10 illustrates conditions in which the bill has come out of the first movable support unit of the bill alignment apparatus in accordance with the first embodiment of the present invention.
Figure 11:
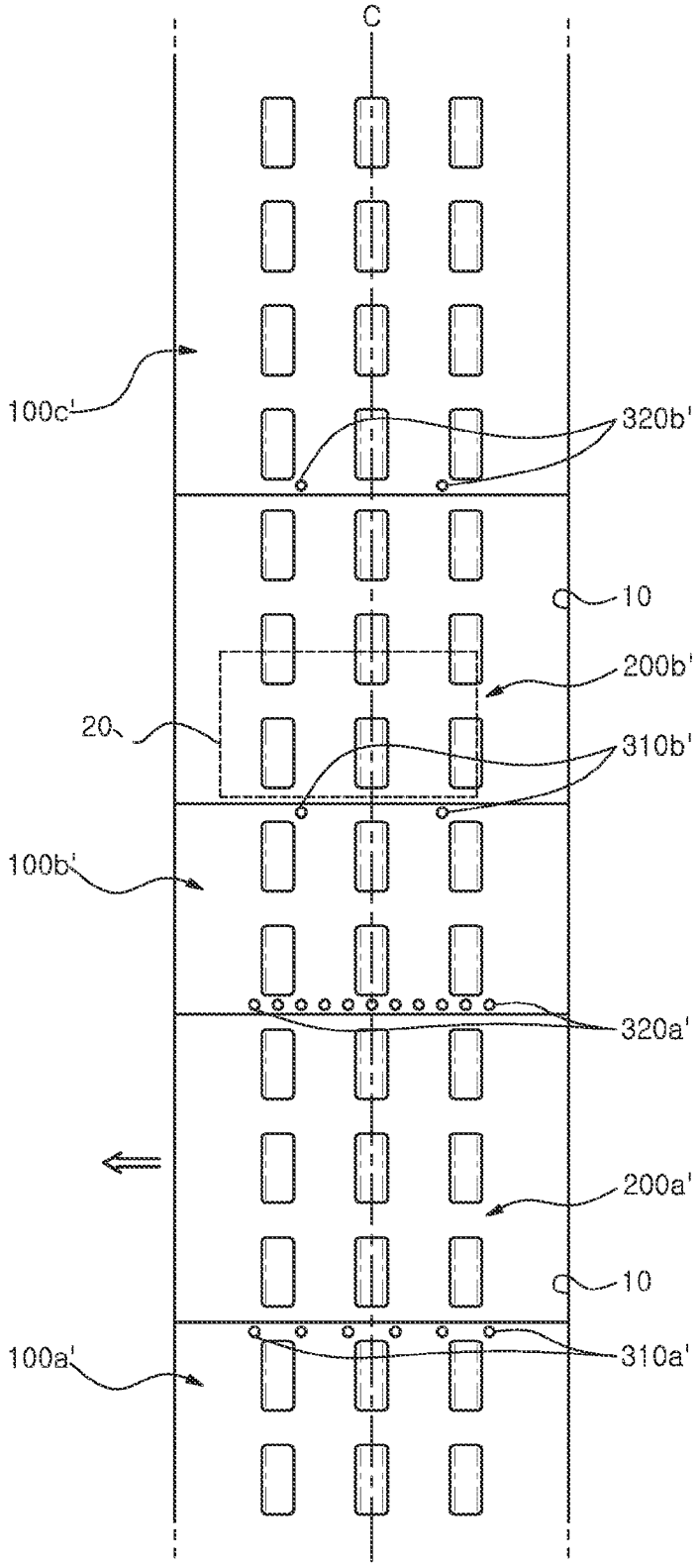
FIG. 11 illustrates conditions in which the bill has entered a second movable support unit of the bill alignment apparatus in accordance with the second embodiment of the present invention.
Figure 12:
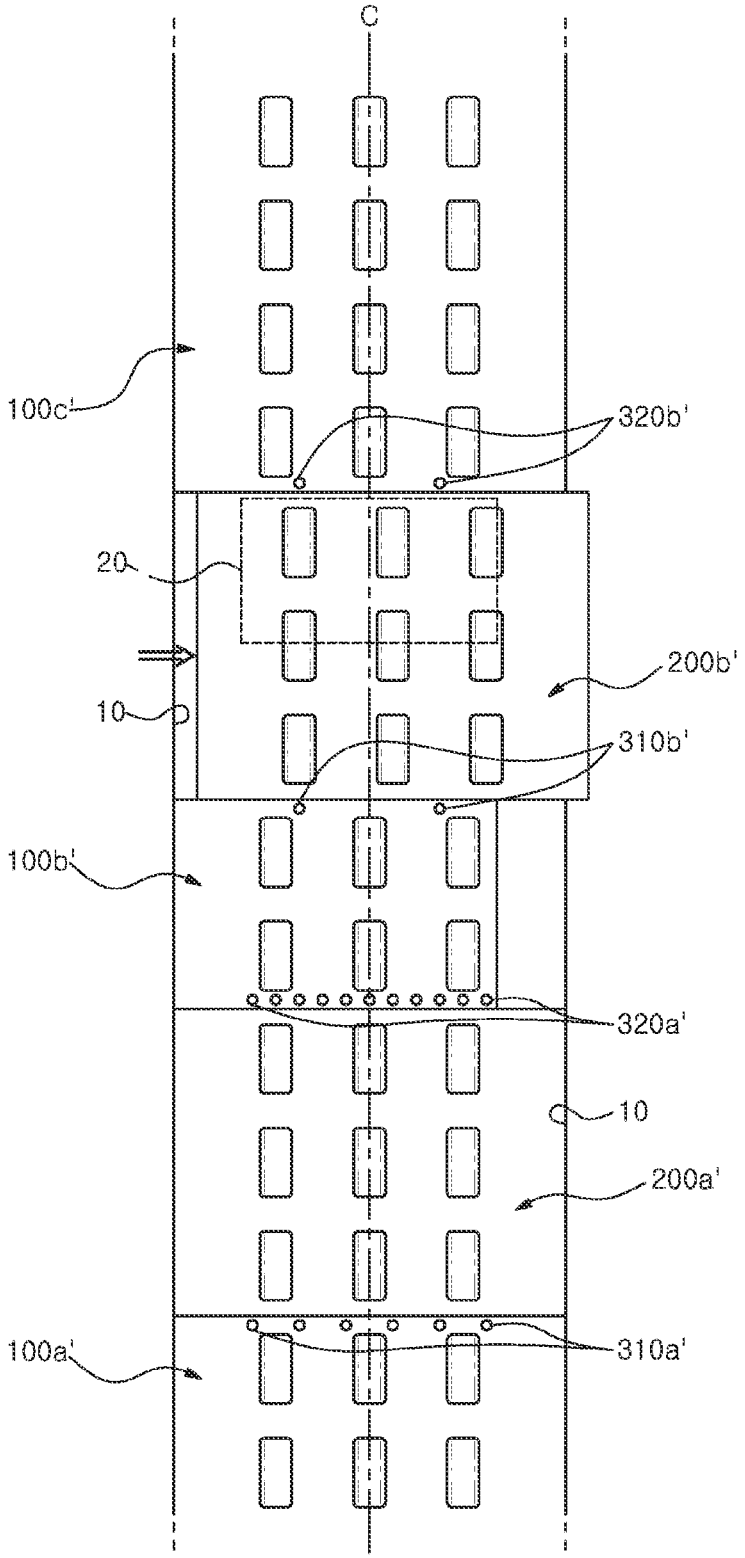
FIG. 12 illustrates conditions in which the second movable support unit on which the bill is placed is moved in the lateral direction for bill alignment, in the bill alignment apparatus in accordance with the second embodiment of the present invention.
Figure 13:
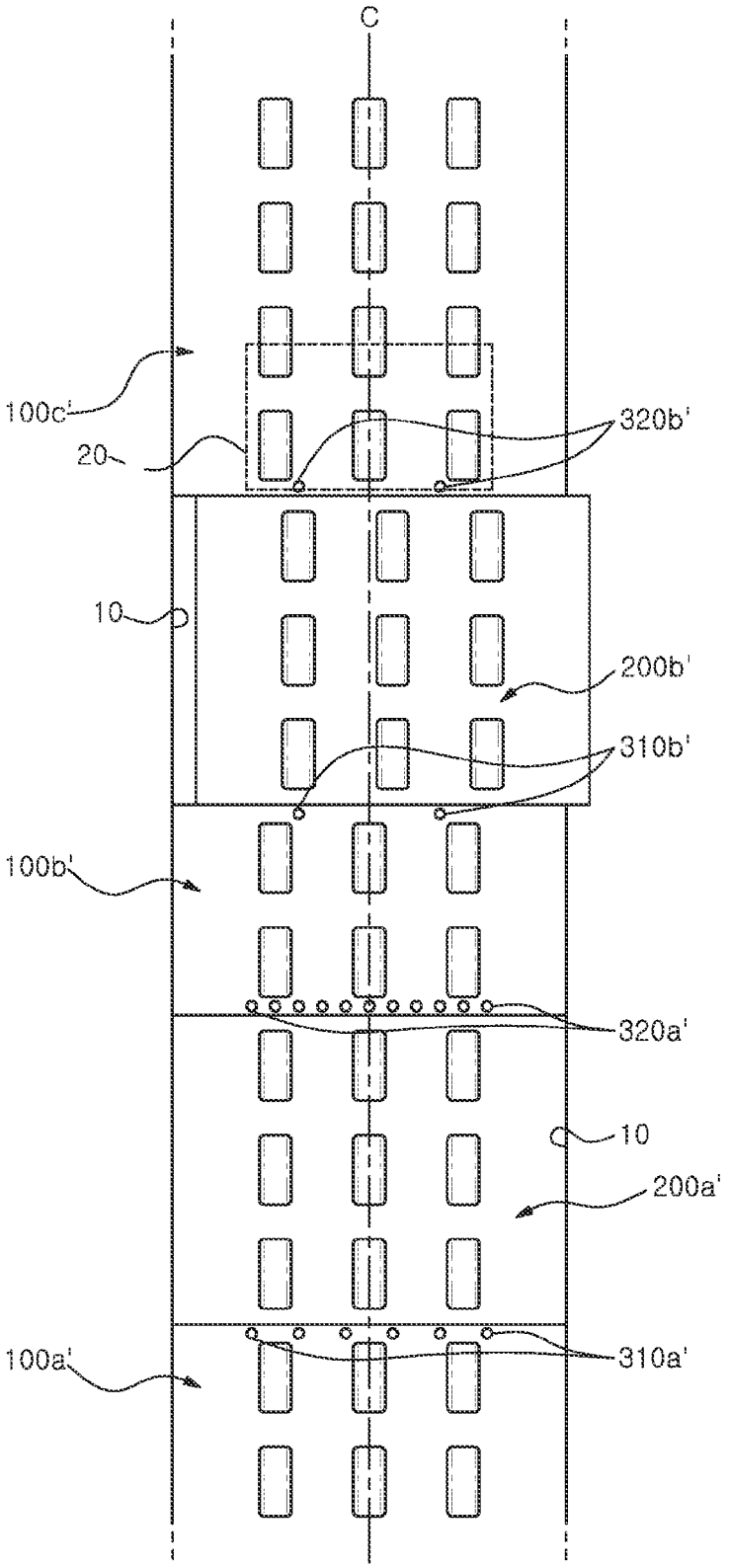
FIG. 13 illustrates conditions in which the bill has come out of the second movable support unit of the bill alignment apparatus in accordance with the first embodiment of the present invention.

FIG. 8 illustrates conditions in which the bill has entered the first movable support unit of the bill alignment apparatus in accordance with the second embodiment of the present invention. FIG. 9 illustrates conditions in which the first movable support unit on which the bill is placed is moved in the lateral direction for bill alignment, in the bill alignment apparatus in accordance with the second embodiment of the present invention. FIG. 10 illustrates conditions in which the bill has come out of the first movable support unit of the bill alignment apparatus in accordance with the first embodiment of the present invention. FIG. 11 illustrates conditions in which the bill has entered the second movable support unit of the bill alignment apparatus in accordance with the second embodiment of the present invention. FIG. 12 illustrates conditions in which the second movable support unit on which the bill is placed is moved in the lateral direction for bill alignment, in the bill alignment apparatus in accordance with the second embodiment of the present invention. FIG. 13 illustrates conditions in which the bill has come out of the second movable support unit of the bill alignment apparatus in accordance with the first embodiment of the present invention.

As shown in FIG. 8, the bill 20 that has passed through the first fixed support unit 100*a*' enters the first movable support unit 200*a*'. At this time, the lateral position of the bill 20 is sensed by some of the first entrance position sensors 310*a*'. The controller 400 receives alignment entrance information and lateral position information of the bill 20 from the first entrance position sensors 310*a*' and calculates the time to move the first movable support unit 200*a*' and a lateral displacement distance of the first movable support unit 200*a*' based on the alignment entrance information and the lateral position information.

As shown in FIG. 9, the bill 20 placed on the first movable support unit 200*a*' is moved by the second transfer rollers 210 of the first movable support unit 200*a*' towards the alignment exit side in the transfer direction of the transfer path 10 and, simultaneously, is aligned with the center line C of the transfer path 10 by lateral movement of the first movable support unit 200*a*'. Here, under the control of the controller 400, the second transfer rollers 210 of the first movable support unit 200*a*' are operated so that the bill 20 can be transferred towards the alignment exit side in the transfer direction of the transfer path 10. Simultaneously, in response to the calculated lateral displacement distance of the first movable support unit 200*a*', the controller 400 moves the first movable support unit 200*a*' in the lateral direction of the transfer path 10.

As shown in FIG. 10, the bill 20 that has come out of the first movable support unit 200*a*' enters the second fixed support unit 100*b*'. Some of the first exit position sensors 320*a*' sense the lateral position of the bill 20 while the bill 20 is continuously moved in the transfer direction of the transfer path 10 both by the second transfer rollers 210 of the first movable support unit 200*a*' and by the first transfer rollers 110 of the second fixed support unit 100*b*'. Thereafter, to more precisely align the bill 20 with the center line C, the bill 20 is moved onto the second movable support unit 200*b*'.

As shown in FIG. 11, the bill 20 that has passed through the second fixed support unit 100*b*' enters the second movable support unit 200*b*'. The controller 400 receives alignment entrance information and lateral position information of the bill 20 from the first exit position sensor 320*a*' and calculates the time to move the second movable support unit 200*b*' and a lateral displacement distance of the second movable support unit 200*b*' based on the alignment entrance information and the lateral position information.

As shown in FIG. 12, the bill 20 that has been placed on the second movable support unit 200*b*' is moved in the transfer direction of the transfer path 10 towards the alignment exit side by the second transfer rollers 210 of the second movable support unit 200*b*' and, simultaneously, is more precisely aligned with the center line C of the transfer path 10 by lateral movement of the second movable support unit 200*b*'. Here, under the control of the controller 400, the second transfer rollers 210 of the second movable support unit 200*b*' are operated so that the bill 20 can be transferred towards the alignment exit side in the transfer direction of the transfer path 10. Simultaneously, in response to the calculated lateral displacement distance of the second movable support unit 200*b*', the controller 400 moves the second movable support unit 200*b*' in the lateral direction of the transfer path 10.

As shown in FIG. 13, the bill 20 that has come out of the second movable support unit 200*b*' enters the third fixed support unit 100*c*'. Here, the bill 20 can be continuously moved in the transfer direction of the transfer path 10 by the second transfer roller 210 of the second movable support unit 200*b*' and the first transfer roller 110 of the third fixed support unit 100*c*'.

Meanwhile, a method for aligning a bill according to an embodiment of the present invention includes placing the bill onto the transfer path, moving the movable support unit in the lateral direction of the transfer path, and moving the bill out of the movable support unit.

In the operation of placing the bill onto the transfer path, the bill is put onto the transfer path in which the movable support unit 200 is installed so as to be movable in the lateral direction of the transfer path. Here, the movable support unit 200 uses the second transfer rollers 210 which are arranged in lines and rows in the movable plate 220 and provides frictional force using the second transfer rollers to the bill 200 to move the bill 20 in the longitudinal direction of the transfer path. The movable support unit 200 can move in the lateral direction of the transfer path along the guide rail 240 that extends in the lateral direction of the transfer path.

Further, in the operation of placing the bill onto the transfer path, bills may be put onto the transfer path in such a way that the bills are spaced apart from each other by a distance corresponding to at least the length of the movable support unit 200. Thereby, each bill 20 can be prevented from being located between the movable support unit 200 and the fixed support unit 100 when the movable support unit 200 is moved in the lateral direction of the transfer path.

In the operation of moving the movable support unit in the lateral direction of the transfer path, the bill that has entered the movable support unit 200 is aligned with the center line C of the transfer path.

The operation of moving the movable support unit in the lateral direction of the transfer path includes calculating a lateral displacement distance of the movable support unit to align the bill with the center line C based on lateral position information of the bill, and moving the movable support unit in the lateral direction in response to the calculated lateral displacement distance.

Furthermore, in the operation of moving the movable support unit in the lateral direction of the transfer path, the bill 20 can be moved in the transfer direction of the transfer path by the second transfer rollers 210 provided on the movable support unit 200.

Here, the bill 20 is moved towards the center line C by the lateral movement of the movable support unit 200 and, simultaneously, is moved in the transfer direction of the transfer path by the second transfer rollers 210 of the movable support unit 200. Thereby, the time it takes to transfer the bill 20 on the movable support unit 200 or pile bills on top of one another is reduced.

In the operation of moving the bill out of the movable support unit, the bill that has been aligned with the center line C of the transfer path is moved from the movable support unit 200 onto the fixed support unit 100. After the bill moves out of the movable support unit 200, the movable support unit 200 returns to its original position.

As described above, in the present invention, a bill that has been supplied onto a transfer path can be continuously transferred in a transfer direction and aligned with a center line by moving a part of the transfer path in the lateral direction.

Furthermore, in the present invention, while the bill is transferred along the transfer path, a separate time to align the bill with the center line is not required. Therefore, the apparatus in accordance with the present invention can rapidly and effectively align the bill with the center line.

In addition, in the present invention, since the position of the bill can be precisely controlled on the transfer path, the bill can be prevented from twisting or wrinkling.

While the invention has been shown and described with respect to the preferred embodiments, it will be understood by those skilled in the art that various changes and modifications may be made without departing from the spirit and scope of the invention as defined in the following claims.

What is claimed is:

1. An apparatus for aligning a bill supplied onto a transfer path with a center line of the transfer path, the apparatus comprising:

a fixed support unit comprising a first transfer roller applying frictional force to the bill so that the bill is moved in a transfer direction of the transfer path;

a movable support unit disposed in succession to the fixed support unit, the movable support unit being provided so as to be movable in a lateral direction of the transfer path to move the bill in the lateral direction of the transfer path;

a bill position sensor sensing a position of the bill;

a controller controlling a lateral displacement of the movable support unit in response to information about the position of the bill, thus aligning the bill with the center line; and a supply unit configured to supply bills onto the transfer path in such a way that the bills are spaced apart from each other by a distance corresponding to at least a length of the movable support unit.

2. The apparatus of claim 1, wherein the fixed support unit comprises:

a first fixed support unit disposed in succession at an entrance side of the movable support unit; and a second fixed support unit disposed in succession at an exit side of the movable support unit.

3. The apparatus of claim 1, wherein the movable support unit comprises:

a second transfer roller providing frictional force to the bill so that the bill that has been moved from the fixed support unit onto the movable support unit is moved in the transfer direction of the transfer path;

a movable plate in which the second transfer roller is rotatably installed; and an actuator moving the movable plate in the lateral direction of the transfer path.

4. The apparatus of claim 1, wherein the bill position sensor comprises:

an entrance position sensor providing information about an alignment entrance of the fixed support unit, the alignment of the bill beginning at the alignment entrance of the fixed support unit; and an exit position sensor providing information about an alignment exit of the fixed support unit, the alignment of the bill being completed at the alignment exit of the fixed support unit.

5. The apparatus of claim 4, wherein the entrance position sensor comprises a plurality of entrance position sensors arranged at positions spaced apart from each other in the lateral direction of the fixed support unit, the entrance position sensors providing lateral position information of the bill to the controller.

6. The apparatus of claim 1, wherein the fixed support unit comprises a plurality of fixed support units, and the movable support unit comprises a plurality of movable support units, wherein the fixed support units and the movable support units successively alternate with each other.

7. A method for aligning a bill, comprising:

supplying a bill onto a transfer path comprising a movable support unit provided so as to movable in a lateral direction in such a way that a subsequent bill to supplied to the transfer path is spaced apart from the bill by a distance corresponding to at least a length of the movable support unit;

moving the movable support unit in the lateral direction of the transfer path to align the bill with a center line of the transfer path when the bill enters the movable support unit; and moving the bill out of the movable support unit after the bill is aligned with the center line of the transfer path.

8. The method of claim 7, wherein moving the movable support unit in the lateral direction of the transfer path comprises:

calculating a lateral displacement distance of the movable support unit to align the bill with the center line of the transfer path based on lateral position information of the bill; and moving the movable support unit in response to the calculated lateral displacement distance.

9. The method of claim 7, wherein moving the movable support unit in the lateral direction of the transfer path comprises moving the bill in a transfer direction of the transfer path using a second transfer roller provided in the movable support unit.

10. The method of claim 7, wherein moving the bill out of the movable support unit comprises returning the movable support unit to an original position thereof after the bill comes out of the movable support unit.

* * * * *